US008162808B2

(12) United States Patent
Cook

(10) Patent No.: US 8,162,808 B2
(45) Date of Patent: Apr. 24, 2012

(54) COMPRESSIBLE CURL BAR

(76) Inventor: Matthew R. Cook, Boise, ID (US)

( * ) Notice: Subject to any disclaimer, the term of this patent is extended or adjusted under 35 U.S.C. 154(b) by 0 days.

(21) Appl. No.: 12/718,651

(22) Filed: Mar. 5, 2010

(65) Prior Publication Data

US 2010/0227747 A1 Sep. 9, 2010

Related U.S. Application Data

(60) Provisional application No. 61/157,779, filed on Mar. 5, 2009.

(51) Int. Cl.
*A63B 21/008* (2006.01)
*A63B 71/00* (2006.01)

(52) U.S. Cl. ..... 482/112; 482/139

(58) Field of Classification Search ..... 482/111–113, 482/139, 106–109, 44–49
See application file for complete search history.

(56) References Cited

U.S. PATENT DOCUMENTS

| | | | | |
|---|---|---|---|---|
| 767,008 | A | 8/1904 | Pelletier | |
| 3,471,145 | A * | 10/1969 | Berger | 482/112 |
| 4,651,986 | A * | 3/1987 | Wang | 482/112 |
| 5,501,646 | A * | 3/1996 | Miller | 482/11 |
| 5,529,559 | A | 6/1996 | Punzalan | |
| 5,735,780 | A | 4/1998 | Fazio | |
| 5,803,879 | A * | 9/1998 | Huang | 482/112 |
| 6,468,190 | B1 * | 10/2002 | Fazio et al. | 482/112 |
| 6,497,640 | B2 | 12/2002 | Loft | |
| 7,087,000 | B1 * | 8/2006 | Walker | 482/107 |
| 7,578,773 | B2 * | 8/2009 | Gronda et al. | 482/111 |
| 2009/0143204 | A1 * | 6/2009 | Gronda et al. | 482/112 |

OTHER PUBLICATIONS

Easy Curves Breast Firming Bar With Dual Resistance Handles. http://www.easycurves.com.

* cited by examiner

*Primary Examiner* — Fenn Mathew
(74) *Attorney, Agent, or Firm* — Robert L. Shaver; Dykas & Shaver, LLP

(57) ABSTRACT

Presented is a curl bar used for lifting weight which has a compressible section in the bar, so a user can compress and uncompress the bar laterally, as well as use the bar for lifting weights or resistance in a direction perpendicular to the bar.

1 Claim, 4 Drawing Sheets

COMPRESSIBLE CURL BAR

PRIORITY/CROSS-REFERENCE TO RELATED APPLICATIONS

This application claims the benefit of U.S. Provisional Application No. 61/157,779, filed Mar. 5, 2009, the disclosure of which is incorporated by reference.

TECHNICAL FIELD

The presently disclosed and claimed inventive concepts generally relates to an apparatus for use in weightlifting, and more particularly to a curl bar which provides resistance in a lateral direction.

BACKGROUND

One method that weightlifters use to add resistance to a weightlifting routine is to utilize a stack of flat plates combined with either a low or a high pulley and a handle. The weightlifter pulls the handle and the handle is connected to a cable and the cable lifts as many of the plates as the weightlifter has selected. In this kind of weightlifting setup, the weightlifter can perform hundreds of different exercises using either the low or the high pulley in the same stack of weights to exercise virtually any muscle in the human body.

One way that weightlifters and other athletes increase the effectiveness of a workout is to find a way to do two exercises at once, or to exercise two muscle groups from the same position. An example of this is when a person stands or sits on a balance ball while performing some form of weightlifting such as dumbbell curls. Part of the athlete's energy and concentration goes into balance and core muscles and part goes into the specific exercise of using the dumbbells in a bicep curl.

Any weightlifting device which can incorporate two exercises into one position or one movement is thus a desirable improvement over previous devices.

SUMMARY OF THE DISCLOSURE

The purpose of the Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the inventive concept(s) of the application, which is measured by the claims, nor is it intended to be limiting as to the scope of the inventive concept (s) in any way.

The invention is a type of curl bar which allows the user to attach the curl bar to a stack of weights or some other resistance device, and pull against the resistance. In this way, it operates like a conventional handle or bar that is attached to weights. The curl bar of the invention also provides the user with the opportunity to press the gripping handles of the curl bar towards each other, against resistance provided by the design of the curl bar.

The curl bar is generally cylindrical with a long axis. It has a right and a left grip handle which are configured to move towards each other when they are pressed towards each other by the user. This can be accomplished as a separate exercise, or can be incorporated into the bar's use as a curl bar. Attached to the curl bar is at least one attachment yoke and typically, one at each end, by which the curl bar is attached to some resistance assembly. The resistance assembly can be a stack of weights, which are well known in the prior art, which are attached to the curl bar of the invention by a cable which passes through a low pulley or a high pulley. The curl bar includes a compressible section which allows the curl bar to shorten and lengthen against resistance along the long axis of the curl bar. The compressible section can be a hollow chamber which is defined in some part of the cylindrical curl bar body. Inside the chamber is a piston which is movable inside the hollow chamber. Moving the piston in and out of the hollow chamber provides resistance in the lateral movement of the left and right gripping handles. This resistance can be caused by a spring inside the hollow chamber, or by the resistance of elastic components such as elastic bands. The resistance to movement of the piston in and out of the hollow chamber may also be caused by the compression of air by movement of the piston in the hollow chamber. The movement of the piston inside the hollow chamber can be controlled and resistance can be adjusted by controlling the size of an opening to the hollow chamber through which air can pass as the piston is moved in and out of the chamber.

The spring can thus provide resistance to the piston going into the chamber and aid in moving the piston toward the outside of the hollow chamber. The piston or plunger can include an air seal such as one or more O-rings in order to form a more airtight seal within the inner chamber. Although the hollow chamber can be in any part of the curl bar, in one embodiment the hollow chamber is inside one of the grip handles of the curl bar.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DETAILED DESCRIPTION OF THE PREFERRED EMBODIMENTS

Figure 1:
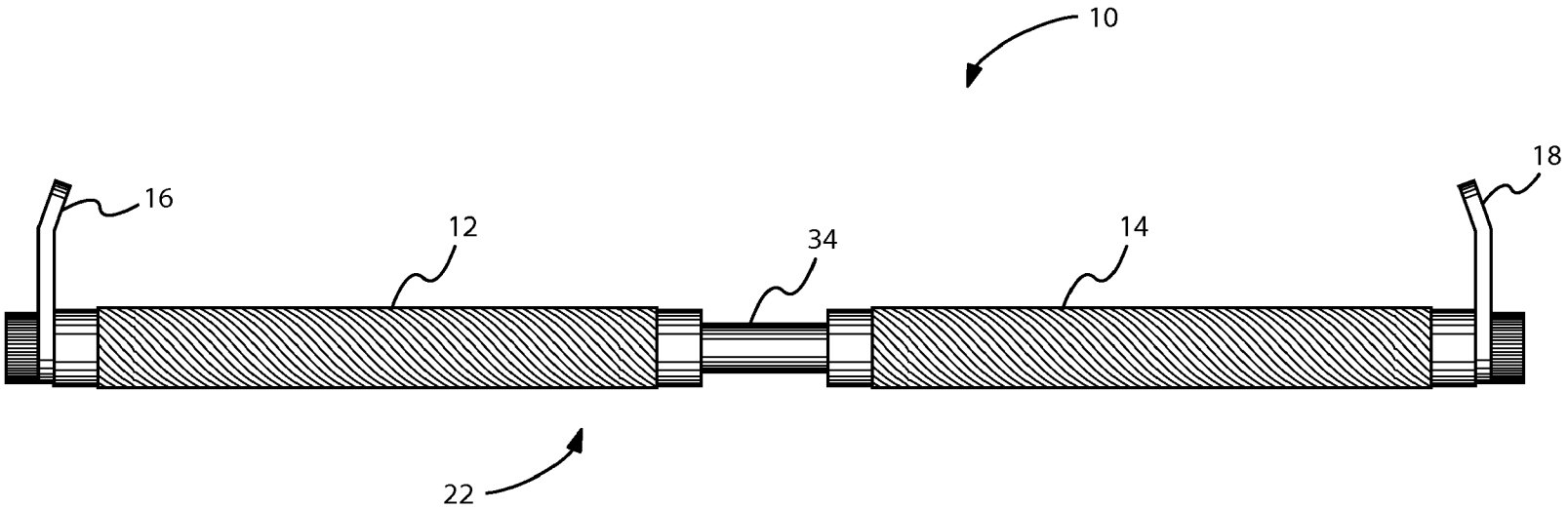
FIG. 1 is a plane view of one embodiment of the invention.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

In the following description and in the figures, like elements are identified with like reference numerals. The use of "e.g.," "etc," and "or" indicates non-exclusive alternatives without limitation unless otherwise noted. The use of "including" means "including, but not limited to," unless otherwise noted.

Shown in FIG. 1 is the curl bar 10 which includes a left grip handle 12, a right grip handle 14, a slide bar 34, and a left attachment yoke 16 and a right attachment yoke 18. Part of the curl bar 10 is the cylindrical curl bar body 22 which has an obvious long axis.

The curl bar of the invention is shown in the enclosed figure. One figure shows the curl bar assembled and another figure shows the curl bar in an exploded view.

The curl bar attaches to a resistance assembly by the attachment yokes 3 which are positioned at either end of the curl bar. The resistance assembly can be a stack of weights, which would typically be enclosed within a conventional weight stack machine in a gym. Other resistance assemblies are possible such as air pistons. The weight can be lifted from a position above the curl bar or below the curl bar, from a low pulley or a high pulley. It would typically be used as a bicep curl, with a cable going from the attachment yokes 3 to a low pulley. While the curl bar of the invention is used to lift a stack of weights, such as in a bicep curl motion, the two grip handles of the curl bar can be pressed together, which provides additional work for the biceps, and work for a different part of the biceps.

Left Side of the Curl Bar:

The left grip handle 12 is a tubular piece of metal threaded at both ends, and has no moving parts. The slide bar 34 passes through collar 38 threaded sleeve 40 and collar 38, and screws into the plunger tip 36, which is preferably brass. The slide bar 9 is also screwed into the cap 10, with 10 being screwed into the end of the left grip handle 12. The left side of left grip handle 12 is sealed by the threaded end cap 42, into which the bolt 44 is screwed through a hole in the left attachment yoke 16. The collar 38 is preferably brass, and is a tubular cylinder and is fitted into threaded sleeve 40. The collar 38 in one version is made of "Oil Light", which is a self lubricating form of sintered brass. The slide bar 34 passes through both collar 38 and threaded sleeve 40, and screws into the plunger tip 36. The slide bar 34 freely rotates within the collar 38 and the threaded sleeve 40.

A plunger tip 36 which fits inside the left grip handle 12 on the left hand side. The bolt 44 on the left has a seal which seals the air from escaping from the hollow chamber in the left grip handle 12. Plunger tip 36 also has a seal in the form of an O ring which stops air from escaping from the right side of the left handle. When the handles are pressed together the air pressure inside the left handle causes resistance so that it is hard to push the right grip handle 14 towards the left grip handle 12. Part 1 on the left grip handle 12 also has a hole drilled from the end of the screw through the length of the screw and out through the threads. When cap 44 is unscrewed from the handle a little, it allows air to escape through this hole which decreases the resistance to the plunger 36 being inserted into the left grip handle 12. This hole forms the air release valve 24.

There is a spring 28 which is inside the left grip handle 12 between the end cap 42 and the plunger tip 36. The spring helps the bar return to its original position after it is compressed, thus moving the two grip handles apart. Attachment yoke 16 is present on both the left and the right sides, and provides attachment points to connect the curl bar 10 to a source of resistance, such as a weight stack.

The person using the bar will grab each handle and do a normal curl using the weight stack or an air cylinder as resistance while the user does a normal curl he may also compress the bar and experience resistance from two different directions. The inward compression targets the inside of the bicep very powerfully.

Figure 2:
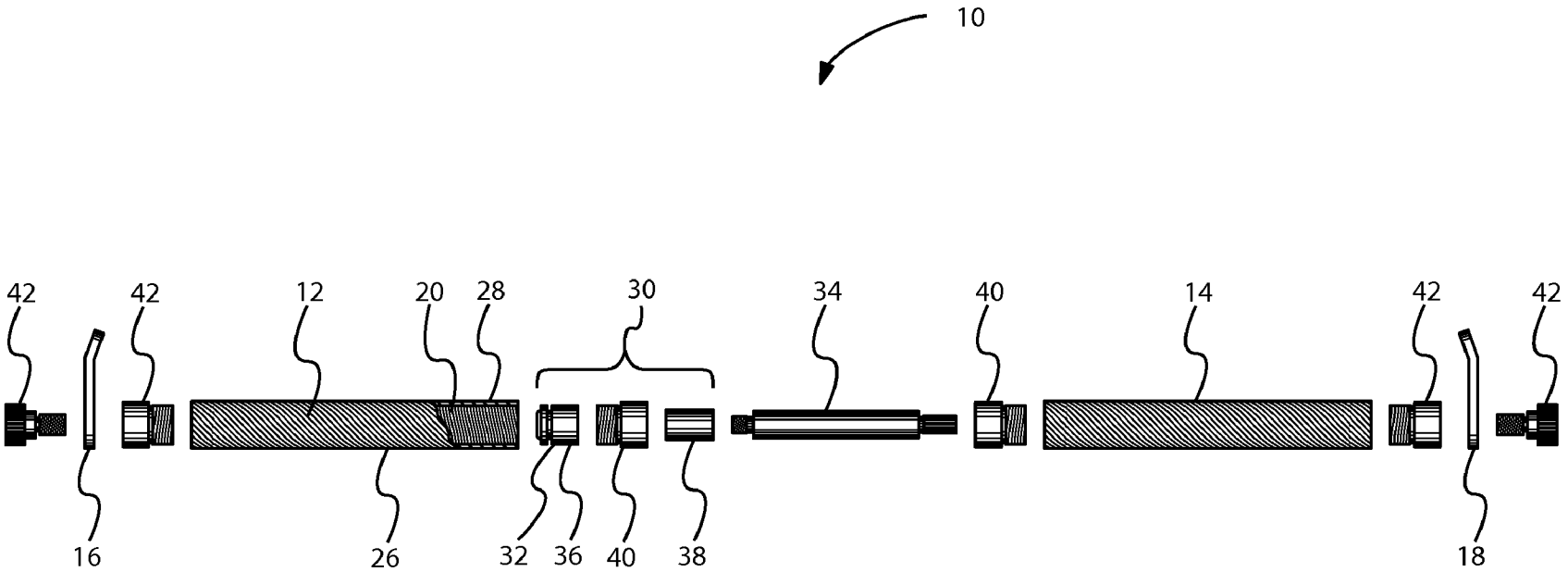
FIG. 2 is an exploded plane view of the curl bar.

The right side of the curl bar is similar to the left side, but may not include a hollow chamber with piston that fits inside. In one embodiment of the invention both sides have the piston and the hollow chamber, and the version shown in FIG. 2 is a version in which the hollow chamber is only on the left side. The right side of the curl bar starts at the threaded sleeve 40 which is equivalent to the threaded sleeve 40 on the left side. The slide bar 34 passes through the threaded sleeve 40 on the right side and screws into threads in the right grip handle 14. A threaded end cap 42 fits into the end of the right grip handle 14 and is similar to the threaded end cap 42 on the left side, but it does not have an air release valve. The right side also includes a right attachment yoke 18 which is attached to the curl bar by a threaded end cap 42.

Figure 3:
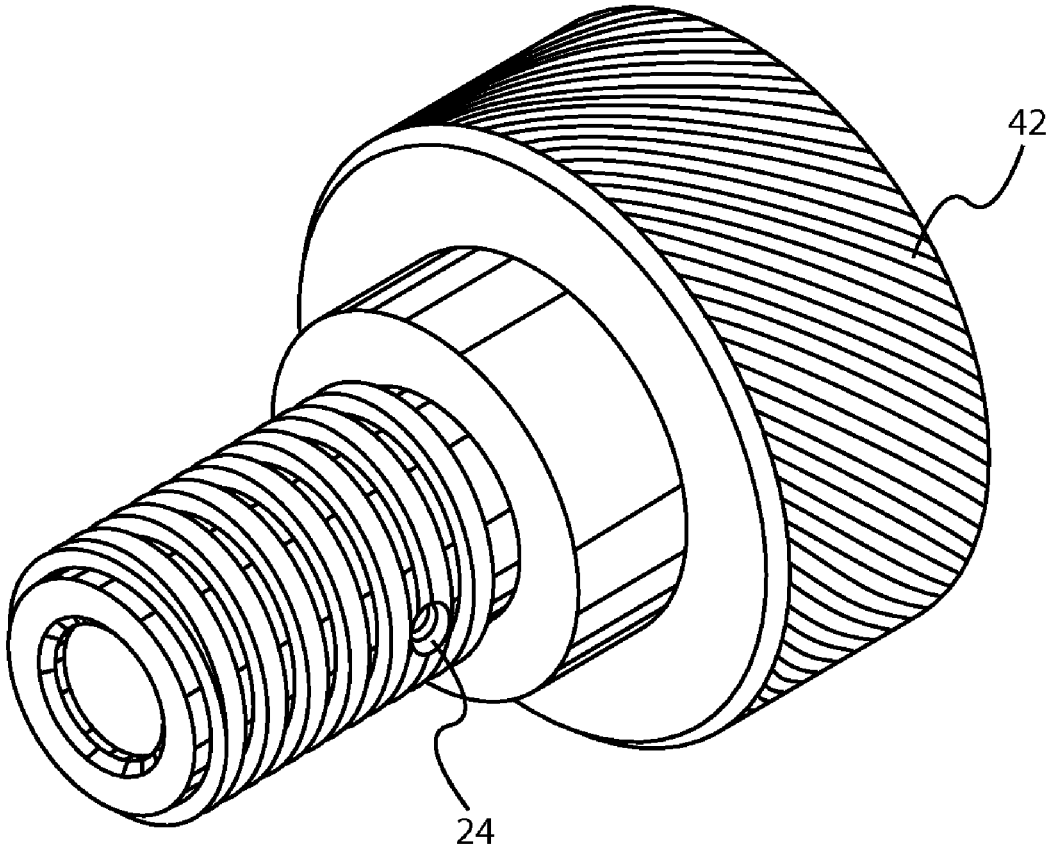
FIG. 3 is a perspective view of the threaded end cap.

Shown in FIG. 3 is the end cap 42 which shows the air release valve 24. FIG. 3 shows the threaded end cap as being hollow, but in a version which did not include the air release valve, the threaded end cap would not need to be hollow.

Figure 4:
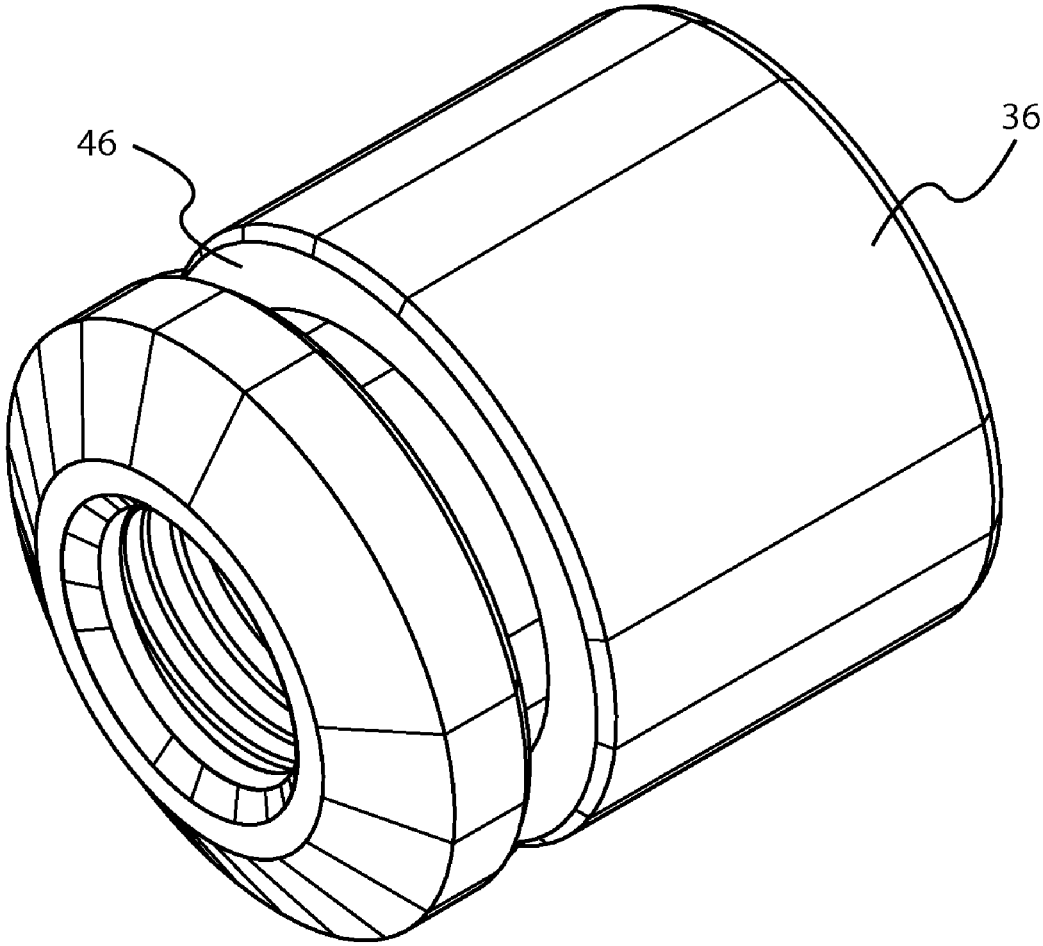
FIG. 4 is a perspective view of the plunger tip.

Shown in FIG. 4 is the plunger tip 36 which in this embodiment includes a groove 46 in which is placed an O-ring (not shown).

While certain exemplary embodiments are shown in Figures and in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

What is claimed is:

1. A curl bar for attachment to a resistance assembly, comprising:

a generally cylindrical curl bar body with a long axis, said curl bar body comprising:

a left and right generally cylindrical grip handle, adjacent to and spaced apart from each other and with both grip handles parallel to said long axis of said curl bar body, configured to move toward each other when pressed toward each other by a user;

at least one attachment yoke attached to said curl bar body, for attaching said curl bar body to said resistance assembly, for providing a user with resistance in a first direction, normal to the long axis of the curl bar body;

a compressible section of said curl bar positioned between and physically joining said left and right grip handles, allowing said curl bar to shorten and lengthen against resistance along the long axis of the curl bar, in which said compressible section is a hollow chamber defined in one of said grip handles of said cylindrical curl bar body, with a piston attached to one grip handle and movable inside said hollow chamber in a remaining grip handle, for providing resistance to lateral movement parallel to the long axis of the curl bar, by compression of air in said hollow chamber by said piston;

an air release valve functionally connected to said hollow chamber, for allowing air to escape from said hollow chamber at a selected rate, for adjusting the degree of resistance to said piston moving through said cylinder, in which said air release valve is a channel drilled in a threaded end cap of said grip handle in which said hollow chamber is located, and is adjustable by turning said threaded end cap.

* * * * *